US005753393A

United States Patent [19]

Mitsumori et al.

[11] Patent Number: 5,753,393

[45] Date of Patent: May 19, 1998

[54] ELECTROPHOTOGRAPHIC PHOTORECEPTOR

[75] Inventors: Teruyuki Mitsumori; Tetsuo Murayama; Atsuo Saita, all of Yokohama, Japan

[73] Assignee: Mitsubishi Chemical Corporation, Tokyo, Japan

[21] Appl. No.: 652,272

[22] Filed: May 22, 1996

[30] Foreign Application Priority Data

May 25, 1995 [JP] Japan ..... 7-126691
Mar. 4, 1996 [JP] Japan ..... 8-45925

[51] Int. Cl.[6] ..... G03G 5/047; G03G 5/09

[52] U.S. Cl. ..... 430/59; 430/73; 430/83

[58] Field of Search ..... 430/59, 73, 83

[56] References Cited

U.S. PATENT DOCUMENTS 4,666,809 5/1987 Matsumoto et al. ..... 430/59
4,987,045 1/1991 Suzuki et al. ..... 430/59
5,290,649 3/1994 Suzuki et al. ..... 430/59
5,453,343 9/1995 Liu et al. ..... 430/73

FOREIGN PATENT DOCUMENTS 0 656 566 6/1995 European Pat. Off. .
58-199353 11/1983 Japan .

*Primary Examiner*—Roland Martin
*Attorney, Agent, or Firm*—Oblon, Spivak, McClelland, Maier & Neustadt, P.C.

[57] ABSTRACT

In the invention, there is provided an electrophotographic photoreceptor comprising a conductive substrate and a photosensitive layer formed thereon, said photosensitive layer containing an arylamine hydrazone compound represented by the following formula [I].

$$P\text{-}\underset{R^1}{\underset{|}{C}}=\underset{R^2}{\underset{|}{C}}\Big)_n CR^3=N-Q \qquad [I]$$

10 Claims, 2 Drawing Sheets

ELECTROPHOTOGRAPHIC PHOTORECEPTOR

BACKGROUND OF THE INVENTION

The present invention relates to an electrophotographic photoreceptor. More particularly it relates to a high-sensitivity electrophotographic photoreceptor having a photosensitive layer containing an organic photoconductive material.

Inorganic photoconductive materials such as selenium, cadmium sulfide and zinc oxide have been popularly used for the photosensitive layers of the electrophotoreceptors. However, since selenium and cadmium sulfide are poisonous substances, they need to be recovered when the used photoreceptor is discarded. These substances also have their own demerits. For instance, selenium is poor in heat resistance because of the crystallization on heating, while cadmium sulfide and zinc oxide have low moisture resistance. Zinc oxide also involves the problem of short life. In view of these, many efforts are being made for the development of a novel photoreceptor.

Recently, research has been made on use of organic photoconductive substances for the photosensitive layers of the electrophotographic photoreceptors, and some of such substances have been commercialized. Organic photoconductive substances are advantageous over the inorganic photoconductive substances in that they are light in weight, can be easily formed to a film, and also easy of manufacture of photoreceptors. Further, some organic photoconductors are capable of producing transparent photoreceptors.

The photoreceptors of the so-called function distribution-type in which different compounds are used for functions of charge carrier generation and carrier transport are gaining ground in the art because they are effective for the enhancement of sensitivity, and some organic photoreceptors of this type have come in practice.

Two types of charge carrier transport material (hereinafter referred to as CTM) are known: in one type a polymeric photoconductive compound such as polyvinyl carbazole is used, and in the other a low-molecular weight photoconductive compound is dispersed in a binder polymer.

It is notable that with the organic low-molecular weight photoconductive compounds, it is possible to easily obtain a photoreceptor with excellent mechanical properties because a polymer having excellent film-forming property, flexibility and adhesivity could be selected as a binder (see, for example, Japanese Patent Application Laid-Open (KOKAI) Nos. 63-172161, 63-174053 and 4-267261, and Japanese Patent Publication (KOKOKU) No. 5-15259).

Generally required functions as an electrophotographic photoreceptor are (1) to be highly chargeable by corona discharge in a dark place, (2) to be little attenuation of surface potential by corona discharge in a dark place, (3) to be large attenuation of surface potential by light irradiation, (4) to be small in residual potential after light irradiation, and (5) to be minimized in variation of surface potential, reduction of sensitivity and accumulation of residual potential after repeated use, and excellent in durability.

Particularly, when residual potential is large, the charge is left even in the exposed portion, so that when toner development is carried out, the toner is developed even in the non-image portion to cause "fogged" image. Also, in the case of reverse development which is often used in printers, the image density or contrast lowers, and in an extreme case, the toner may fail to attach sufficiently to the image portion, resulting in formation of the "void" images. These defects are quite detrimental to image reproducibility and hinder commercialization of this electrophotographic system.

With spreading laser printers of the reverse development system in recent years, it is intensely required the development of CTM having higher sensitivity, higher carrier (hole) mobility, lower residual potential and more excellent durability, and also suited for use in combination with a charge generation material for long-wavelength light such as phthalocyanine pigments.

By the present inventors' pursued studies on the organic low-molecular weight photoconductive compounds for providing an electrophotographic photoreceptor having high sensitivity, low residual potential and high durability, it has been found that by using a specific arylamine hydrazone compound as the photoconductive material of an electrophotographic photoreceptor, the obtained photoreceptor has high sensitivity and low residual potential. The present invention has been attained on the basis of this finding.

SUMMARY OF THE INVENTION

The object of the present invention is to provide an electrophotographic photoreceptor which is remarkably high in sensitivity, low in residual potential which is causative of fogged image, minimized in accumulation of residual potential and variation of surface potential, variation of sensitivity due to repeated use or emission of light because of little optical fatigue, and also excellent in durability.

To accomplish the aims, in an aspect of the present invention, there is provided an electrophotographic photoreceptor comprising a conductive substrate and a photosensitive layer formed on the conductive substrate, which contains an arylamine hydrazone compound represented by the following formula [I] on a conductive substrate:

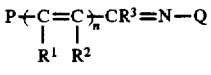

[I]

wherein n is an integer of 2 or more;

$R^1$, $R^2$ and $R^3$ represent independently a hydrogen atom, an alkyl group which may have one or more substituent groups, an aryl group which may have one or more substituted groups, or a heterocyclic group which may have one or more substituent groups, and $R^1$'s and $R^2$'s in each repeating unit may be identical or different;

P is a group represented by the following formula [II]:

[II]

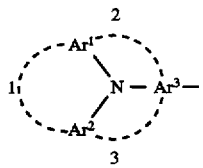

wherein $Ar^1$ and $Ar^2$ each represents an alkyl group which may have a substituent group, an aryl group which may have one or move substituent groups or a heterocyclic group which may have one or more substituent groups, and they may be identical or different; $Ar^3$ represents an arylene group which may have a one or more substituent groups or a heterocyclic group which may have one or more substituent groups; dotted line 1, dotted line 2 and dotted line 3 indicate that $Ar^1$ and $Ar^2$, $Ar^1$ and $Ar^3$, and $Ar^2$ and $Ar^3$ may be linked directly or through a linking group, respectively;

Q is a group represented by the following formula [III]:

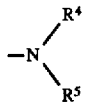

[III]

wherein $R^4$ and $R^5$ each represents an aryl group which may have one or more substituent groups, a heterocyclic group which may have one or more substituent groups, an alkyl group which may have one or more substituent groups, or an aralkyl group which may have a substituent group, provided that a compound where P in the formula [I] is represented by the following formula [IV] is excluded:

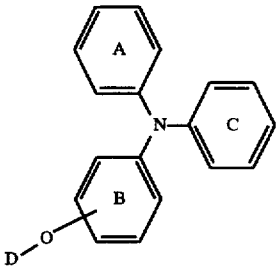

[IV]

wherein A, B and C benzene rings, which may be identical or different, may independently have one or more substituent groups; and D is a group represented by the following formula [V], [VI] or [VII]:

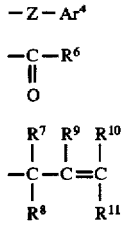

[V] [VI] [VII]

wherein, in the formula [V], Z represents an alkylene group which may have one or more substituent groups, and $Ar^4$ represents an aryl group which may have one or more substituent groups or a heterocyclic group which may have one or more substituent groups; in the formula [VI], $R^6$ represents an alkyl group which may have one or more substituent groups, an aryl group which may have one or more substituent groups, a heterocyclic group which may have one or more substituent groups, or an aralkyl group which may have one or more substituent groups; and in the formula [VII], $R^7$, $R^8$, $R^9$, $R^{10}$ and $R^{11}$ represent independently a hydrogen atom, an aralkyl group which may have one or more substituent groups, an aryl group which may have one or more substituent groups or a heterocyclic group which may have one or more substituent groups.

DETAILED DESCRIPTION OF THE INVENTION

Figure 1:
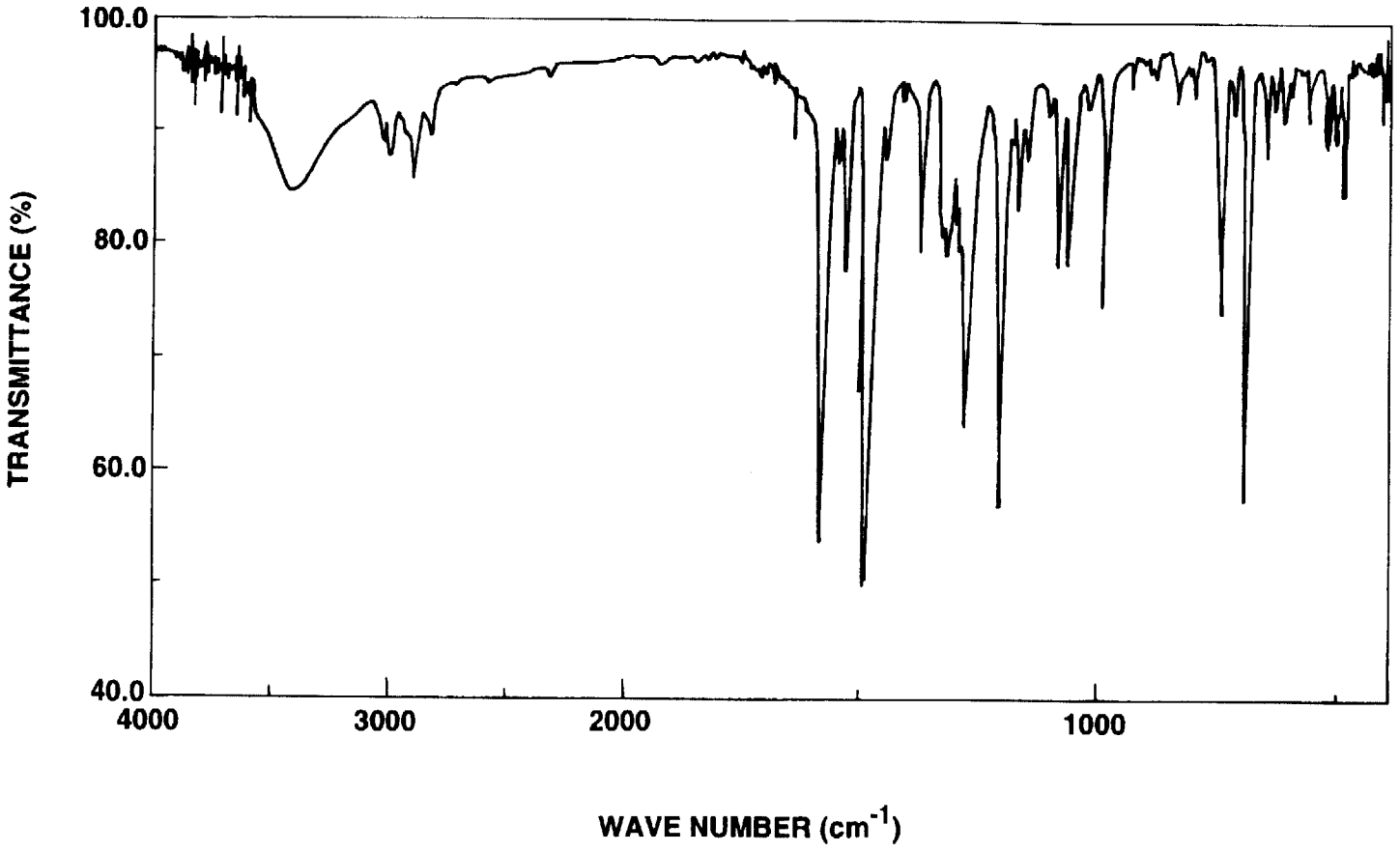
FIG. 1 is an IR absorption spectrum of the arylamine hydrazone compound obtained in Production Example 1.

The present invention is described in more detail below.

The electrophotographic photoreceptor according to the present invention contains an arylamine hydrazone compound represented by the formula [I] in its photosensitive layer.

In the formula [I], n is an integer of 2 or more, preferably $2 \leqq n \leqq 6$.

$R^1$, $R^2$ and $R^3$ each represents a hydrogen atom; an $C_1$–$C_6$ alkyl group such as methyl, ethyl and propyl; an aryl group such as phenyl, naphthyl and anthracenyl; or a heterocyclic group such as pyrrolyl, thienyl, furyl and carbazolyl. Particularly, hydrogen atom or an alkyl group is preferred. These alkyl, aryl and heterocyclic groups may have one or more substituent groups. As the substituent groups, halogen atoms such as chlorine atom, bromine atom and iodine atom; $C_1$–$C_6$ alkyl groups such as methyl, ethyl, propyl, butyl and hexyl; alkoxy groups such as methoxy, ethoxy and butoxy; aralkyl groups such as benzyl, naphthylmethyl and phenethyl; aryloxy groups such as phenoxy and tolyloxy; arylalkoxy groups such as benzyloxy and phenethyloxy; aryl groups such as phenyl and naphthyl; heterocyclic groups such as thienyl, pyrrolyl, furyl and carbazolyl; arylvinyl groups such as styryl and naphthylvinyl; dialkylamino groups such as dimethylamino and diethylamino; diarylamino groups such as diphenylamino and dinaphthylamino; diaralkylamino groups such as dibenzylamino and diphenethylamino; diheterocyclic amino groups such as dipyridylamino and dithienylamino; diallylamino groups; and disubstituted amino groups comprising combinations of the said amino substituent groups may be exemplified. $R^1$'s and $R^2$'s in each repeating unit may be identical or different.

In the formula [II] representing P in the formula [I], $Ar^1$ and $Ar^2$ represent independently an $C_1$–$C_6$ alkyl group such as methyl, ethyl and propyl; an aryl group such as phenyl, naphthyl and anthracenyl; or a heterocyclic group such as pyrrolyl, thienyl, furyl and carbazolyl. $Ar^1$ and $Ar^2$ may be identical or different. Particularly, substituted or non-substituted phenyl group is preferred. These alkyl groups, aryl groups and heterocyclic groups may have one or more substituent groups. As the substituent groups, hydroxyl groups; halogen atoms such as chlorine atom, bromine atom and iodine atom; $C_1$–$C_6$ alkyl groups such as methyl, ethyl, propyl, butyl and hexyl; alkoxy groups such as methoxy, ethoxy and butoxy; allyl groups; aralkyl groups such as benzyl, naphthylmethyl and phenethyl; aryloxy groups such as phenoxy and tolyloxy; arylalkoxy groups such as benzyloxy and phenethyloxy; aryl groups such as phenyl and naphthyl; arylvinyl groups such as styryl and naphthylvinyl; heterocyclic groups such as thienyl, pyrrolyl, furyl and carbazolyl; dialkylamino groups such as dimethylamino and diethylamino; diarylamino groups such as diphenylamino and dinaphthylamino; diaralkylamino groups such as dibenzylamino and diphenethylamino; diheterocyclic amino groups such as dipyridylamino and dithienylamino; diallylamino groups; and disubstituted amino groups comprising combinations of the said amino substituent groups may be exemplified.

$Ar^3$ represents arylene groups such as phenylene, naphthylene and anthracenylene; and heterocyclic groups such as pyrrolidone, thienylidene and furylidene. Particularly, phenylene and naphthylene are preferred. The arylene groups and divalent heterocyclic groups may have one or more substituent groups. As the substituent groups, hydroxyl groups; halogen atoms such as chlorine atom, bromine atom and iodine atom; $C_1$–$C_6$ alkyl groups such as methyl, ethyl, propyl, butyl and hexyl; alkoxy groups such as methoxy, ethoxy and butoxy; allyl groups; aralkyl groups such as benzyl, naphthylmethyl and phenethyl; aryloxy groups such as phenoxy and tolyloxy; arylalkoxy groups such as benzyloxy and phenethyloxy; aryl groups such as phenyl and naphthyl; heterocyclic groups such as thienyl, pyrrolyl, furyl and carbazolyl; arylvinyl groups such as styryl and naphthylvinyl; dialkylamino groups such as dimethylamino and diethylamino; diarylamino groups such as diphenylamino and dinaphthylamino; diaralkylamino groups such as dibenzylamino and diphenethylamino; diheterocyclic amino groups such as dipyridylamino and dithienylamino; diallylamino groups; and disubstituted amino groups comprising combinations of the said amino substituent groups may be exemplified.

The dotted line 1 in the formula [II] indicates that $Ar^1$ and $Ar^2$ may be linked directly as shown by the dotted line or via a linking group. For example, the formula [II] may take the structures represented by the following formulae [X], [XI], [XII], [XIII] and [XIV]:

[X]

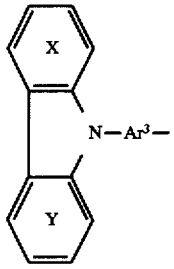

[XI]

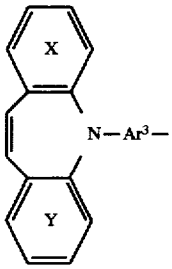

[XII]

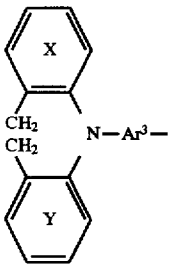

[XIII]

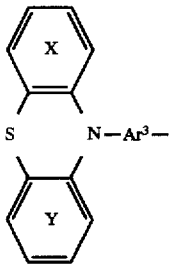

-continued

[XIV]

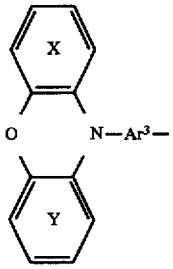

The dotted line 2 in the formula [II] indicates that $Ar^1$ and $Ar^3$ may be linked directly as shown by the dotted line or via a linking group. For example, the formula [II] may take the structures represented by the following formulae [XV], [XVI], [XVIII] and [XIX]:

[XV]

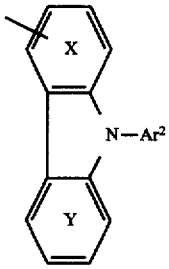

[XVI]

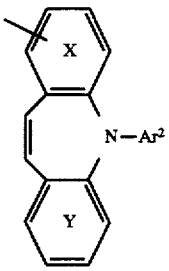

[XVII]

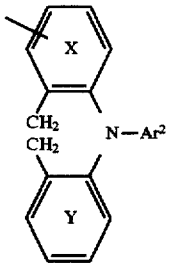

[XVIII]

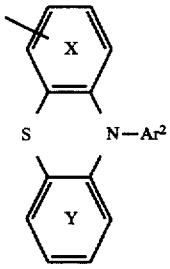

-continued

[XIX]

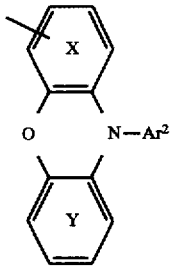

The dotted line 3 indicates that $Ar^2$ and $Ar^3$ may be linked directly as shown by the dotted line or via a linking group. The same structures as in the case of the dotted line 2 ([XV]–[XIX]) may be taken.

The compound of which the dotted lines 2 and 3 are absent is preferable.

In the above formulae [X]–[XIX], X and Y represent independently a benzene ring which may have one or more substituent groups. As the substituent groups, halogen atoms such as chlorine atom, bromine atom and iodine atom; $C_1$–$C_6$ alkyl groups such as methyl, ethyl and propyl; alkoxy groups such as methoxy, ethoxy and propyloxy; aryl groups such as phenyl and naphthyl; dialkylamino groups such as dimethylamino; diarylamino groups such as diphenylamino; diaralkylamino groups such as dibenzylamino; diheterocyclic amino groups such as dipyridylamino; diallylamino groups; and substituted amino groups such as disubstituted amino groups comprising combinations of the said amino substituent groups may be exemplified. X and Y may be identical or different. Particularly, of these substituent group groups, hydrogen atom, methyl group and methoxy group are preferred. These alkyl, alkoxy and aryl groups may further have one or more substituent groups which include hydroxyl groups; halogen atoms such as chlorine atom, bromine atom and iodine atom; $C_1$–$C_6$ alkyl groups such as methyl, ethyl, propyl, butyl and hexyl; alkoxy groups such as methoxy, ethoxy and butoxy; allyl groups; aralkyl groups such as benzyl, naphthylmethyl and phenethyl; aryloxy groups such as phenoxy and tolyloxy; allylalkoxy group such as benzyloxy and phenethyloxy; aryl groups such as phenyl and naphthyl; arylvinyl groups such as styryl and naphthylvinyl; dialkylamino groups such as dimethylamino and diethylamino; diarylamino groups such as diphenylamino and dinaphthylamino; diaralkylamino groups such as dibenzylamino and diphenethylamino; diheterocyclic amino groups such as dipyridylamino and dithienylamino; diallylamino groups; and disubstituted amino groups comprising combinations of the said amino substituent groups.

P in the formula [I] is preferably a group represented by the following formula [VIII]:

[VIII]

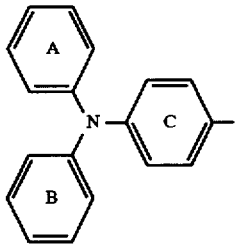

wherein A, B and C, benzene rings, which may be identical or different may have one or more substituent groups. Substituent groups of A, B and C benzene rings may be the same as those of X and Y mentioned above. It is preferable that A, B and C benzene rings are non-substituted or substituted with methyl group or methoxy group, more preferably methyl group. It is further preferable that at least one of A and B benzene rings at para-position is substituted with methyl group.

Q in the formula [I] is a group represented by the following formula [III]:

[III]

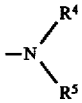

wherein $R^4$ and $R^5$ represent independently an aryl group such as phenyl, naphthyl and anthracenyl; a heterocyclic group such as pyrrolyl, thienyl, furyl and carbazolyl; an $C_1$–$C_6$ alkyl group such as methyl, ethyl and propyl; an aralkyl group such as benzyl and phenethyl; or an allyl group. These aryl, heterocyclic, alkyl and aralkyl groups may have one or more substituent groups. As the substituent groups, halogen atoms such as chlorine atom, bromine atom and iodine atom; $C_1$–$C_6$ alkyl groups such as methyl, ethyl, propyl, butyl and hexyl; alkoxy groups such as methoxy, ethoxy and butoxy; allyl groups; aralkyl groups such as benzyl, naphthylmethyl and phenethyl; aryloxy groups such as phenoxy and tolyloxy; arylalkoxy groups such as benzyloxy and phenethyloxy; aryl groups such as phenyl and naphthyl; heterocyclic groups such as thienyl, pyrrolyl, furyl and carbazolyl; arylvinyl groups such as styryl and naphthylvinyl; dialkylamino groups such as dimethylamino and diethylamino; diarylamino groups such as diphenylamino and dinaphtylamino; diaralkylamino groups such as dibenzylamino and diphenethylamino; diheterocyclic amino groups such as dipyridylamino and dithienylamino; diallylamino groups; and disubstituted amino groups comprising combinations of the said amino substituent groups may be exemplified. Among these substituent groups, the substituent groups other than halogen atoms are preferable. Further, it is preferable that at least one of $R^4$ and $R^5$ is an aryl group which may have a substituent group.

$R^4$ and $R^5$ are not linked to each other. A compound in which $R^4$ and $R^5$ are directly linked to each other to form a carbazole ring is disclosed in Japanese Patent Publication (KOKOKU) No. 6-44159, but in this Japanese KOKOKU, there is no description for the case where $R^4$ and $R^5$ are not linked.

However, the compounds of the formula [I] in which P is a group represented by the following formula [IV] are excluded:

[IV]

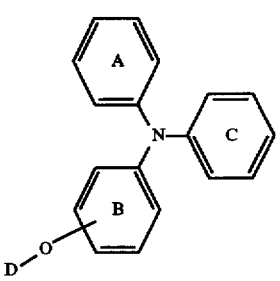

wherein A, B and C benzene rings may be identical or different, which may have one or more substituent groups; and D is a group represented by the formula [V], [VI] or [VII]:

$$-Z-Ar^4 \quad [V]$$

-continued

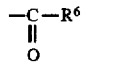

[VI]

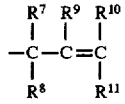

[VII]

wherein, in the formula [V], Z represents an alkylene group which may have a substituent group, and $Ar^4$ is an aryl group which may have a substituent group or a heterocyclic group which may have a substituent group; in the formula [VI], $R^6$ represents an alkyl group which may have a substituent group, an aryl group which may have a substituent group, a heterocyclic group which may have a substituent group, or an aralkyl group which may have a substituent group; and in the formula [VII], $R^7$, $R^8$, $R^9$, $R^{10}$ and $R^{11}$ represent independently a hydrogen atom, an $C_1$–$C_6$ alkyl group which may have a substituent group, an aryl group which may have a substituent group, or a heterocyclic group which may have a substituent group.

Typical examples of the arylamine hydrazone compounds represented by the formula [I] are shown below. The compounds shown here are merely illustrative, and the arylamine compounds usable in the present invention are not limited to these examples.

Exemplary compound

No. 1

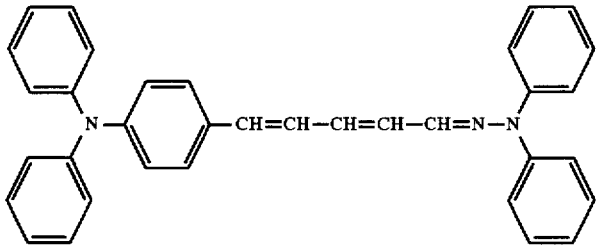

No. 2

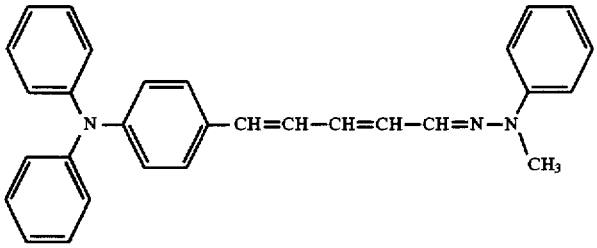

No. 3

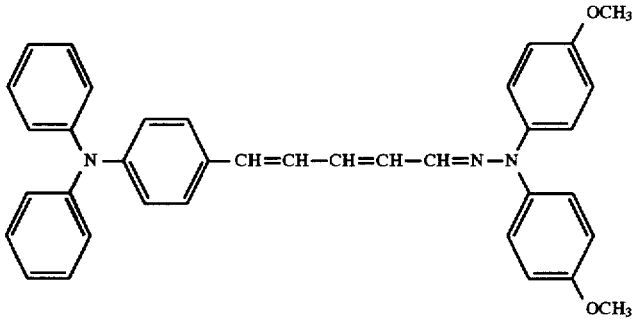

-continued
No. 4
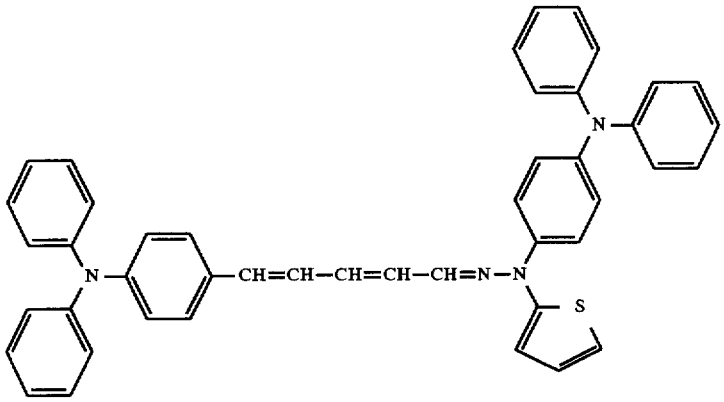
No. 5
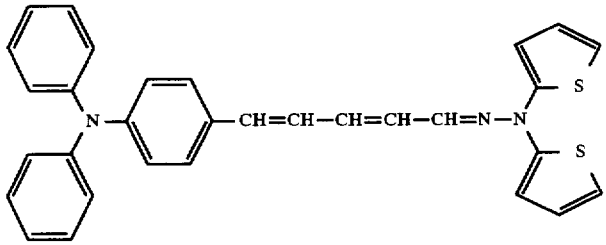
No. 6
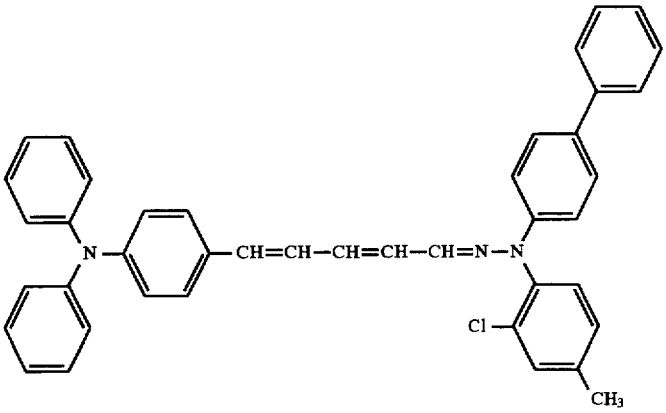
No. 7
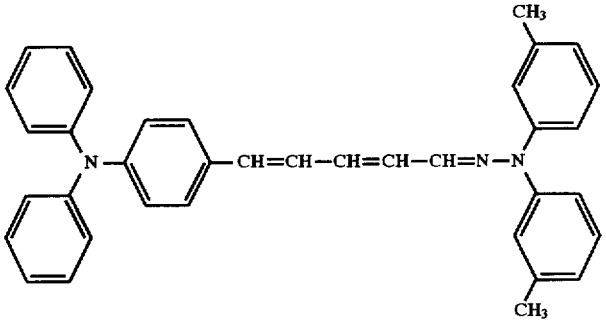

-continued
No. 8
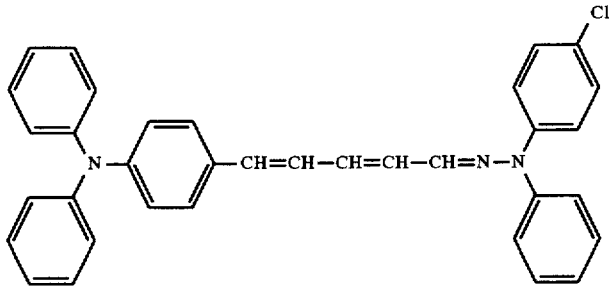
No. 9
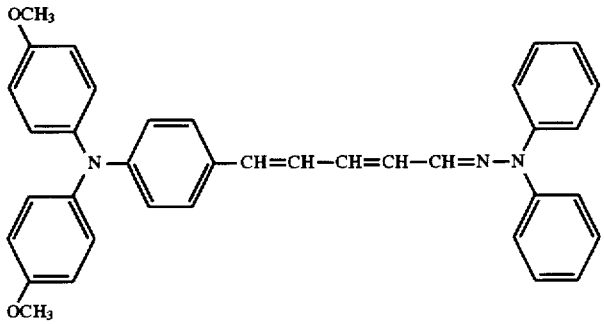
No. 10
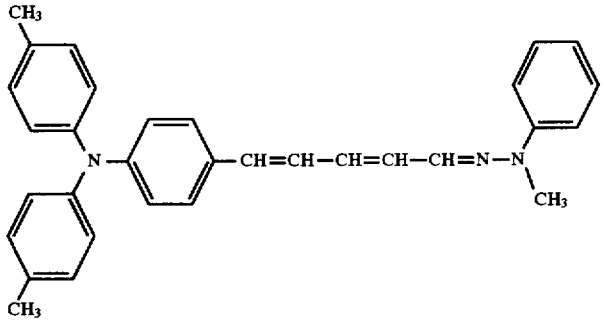
No. 11
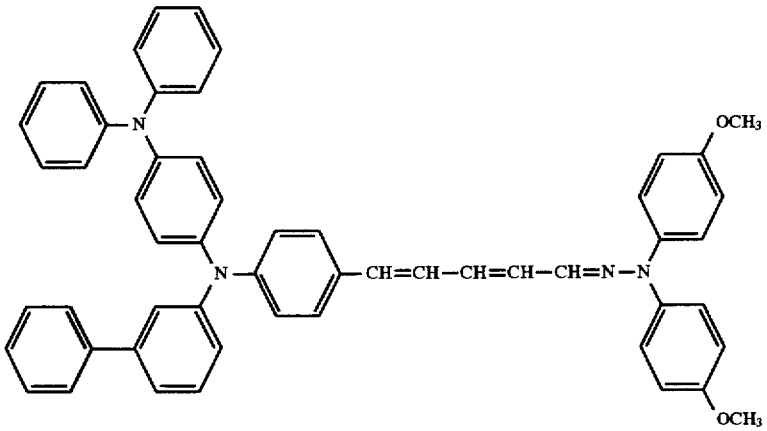

-continued
No. 12
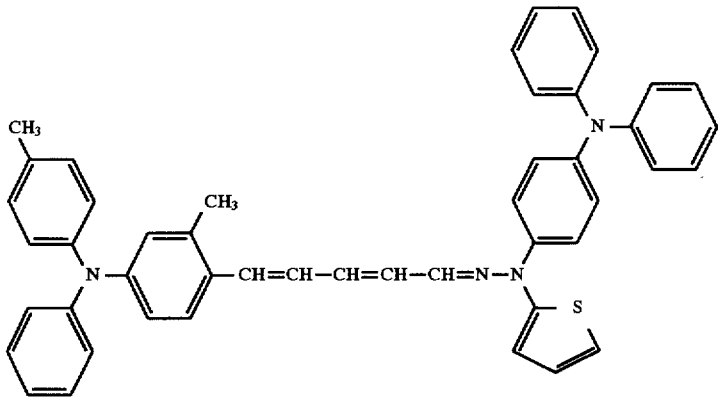
No. 13
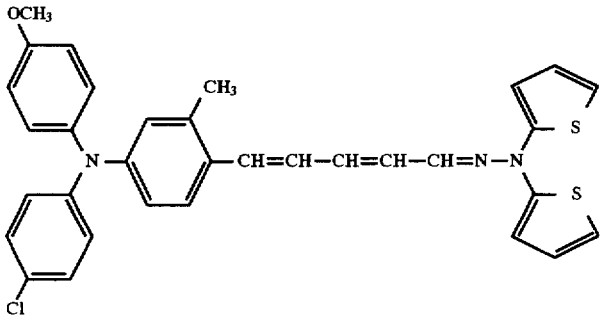
No. 14
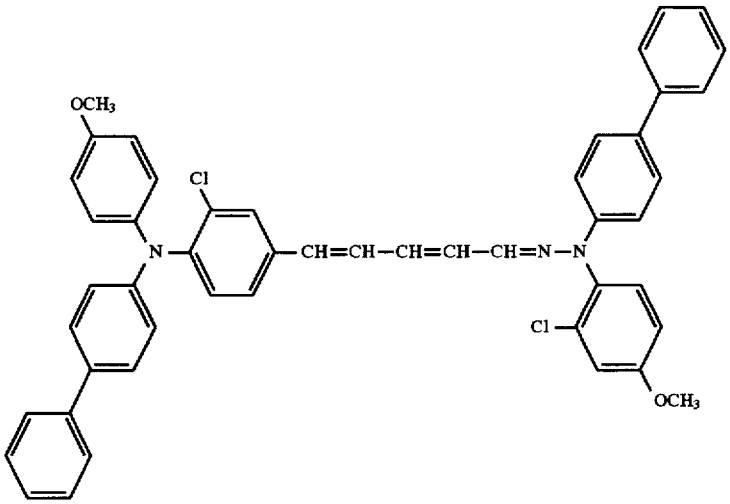
No. 15
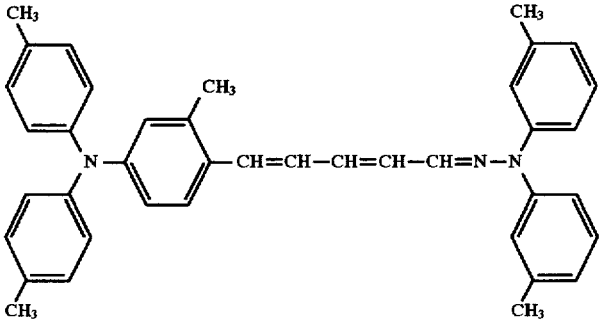

-continued
No. 16
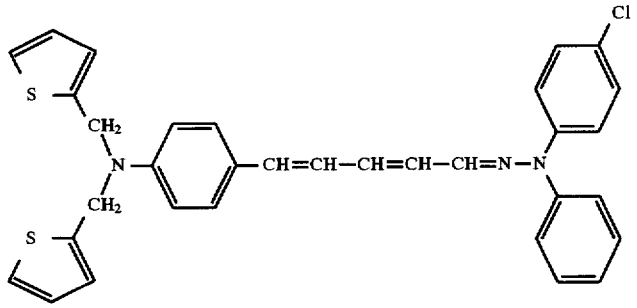
No. 17
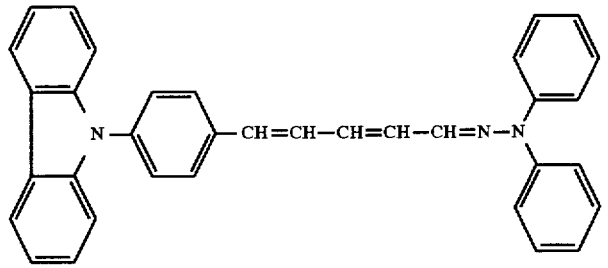
No. 18
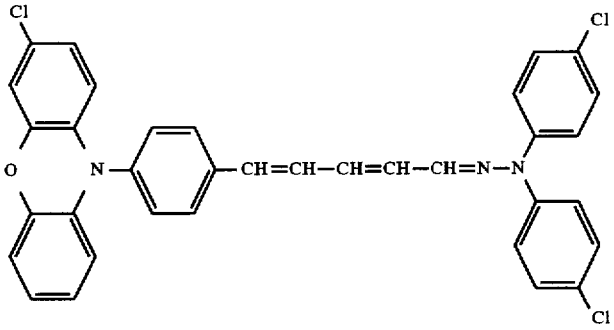
No. 19
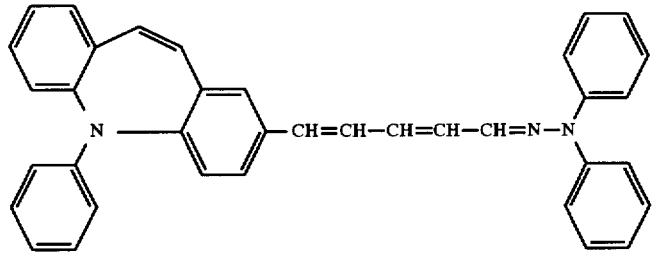
No. 20
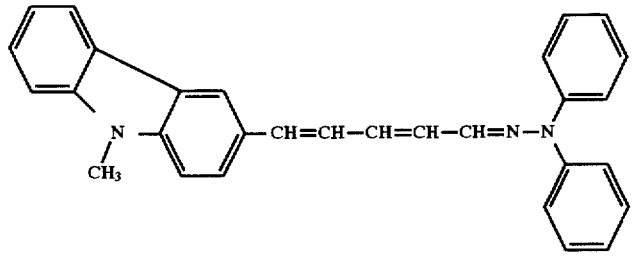

-continued
No. 21
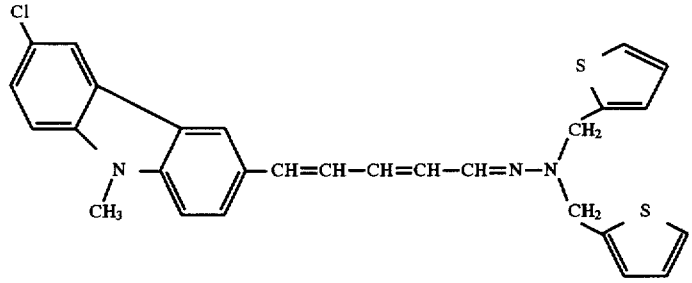
No. 22
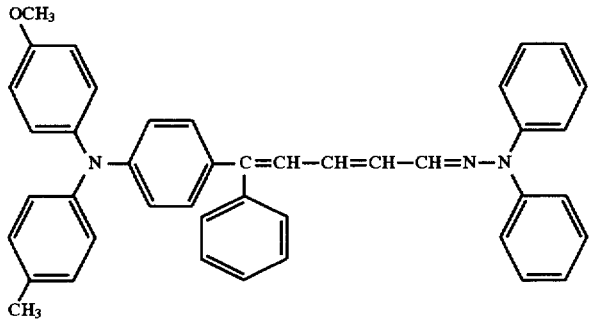
No. 23
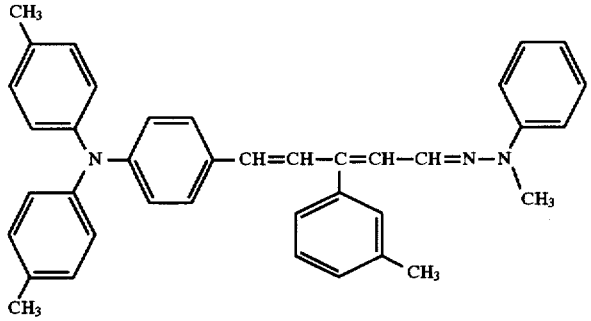
No. 24
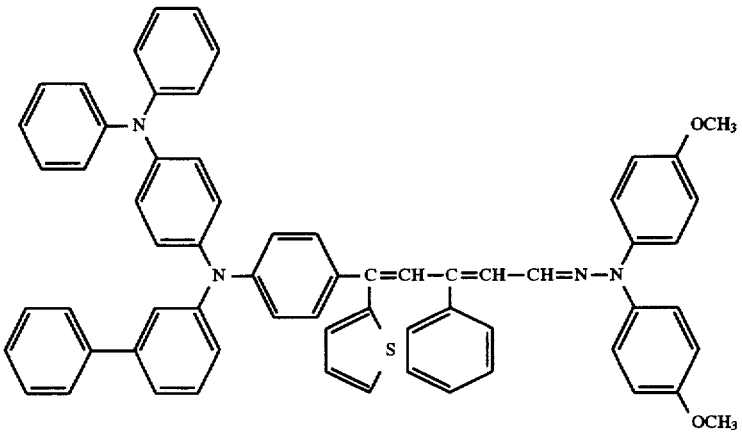

-continued
No. 25
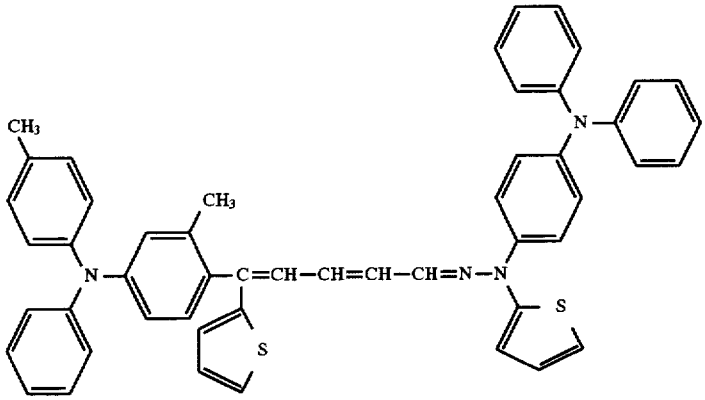
No. 26
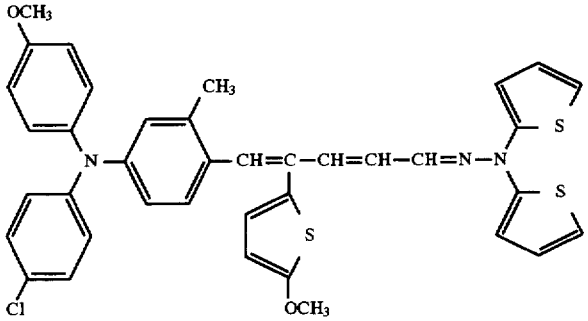
No. 27
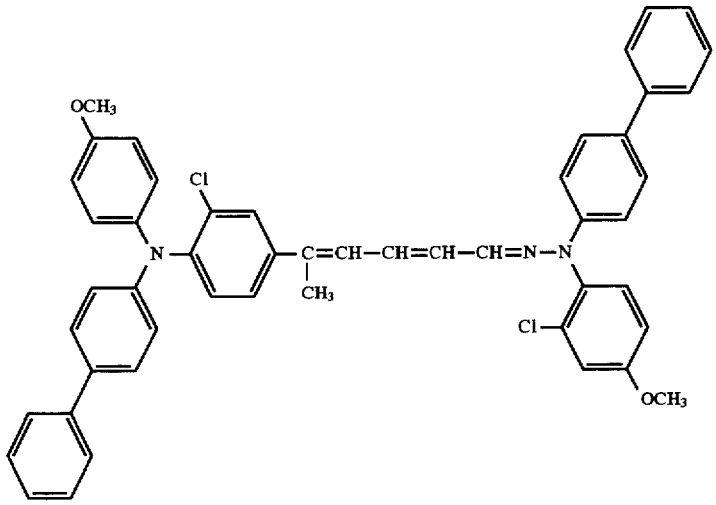
No. 28
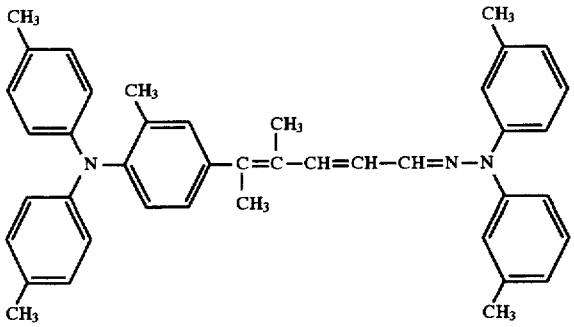

-continued
No. 29
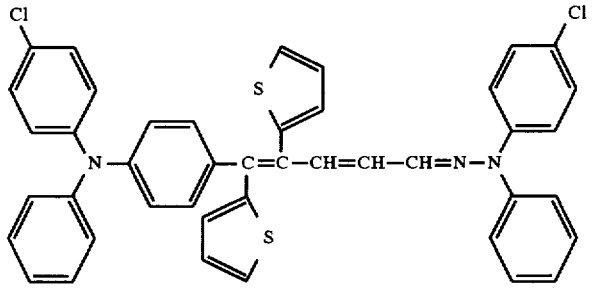
No. 30
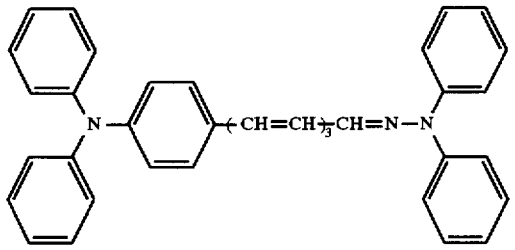
No. 31
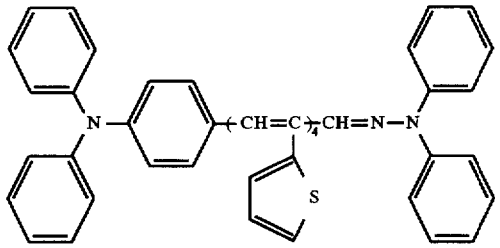
No. 32
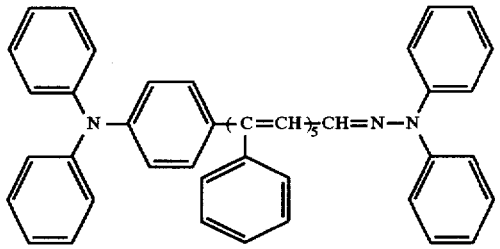
No. 33
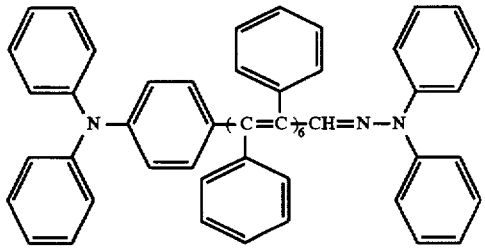

-continued
No. 34
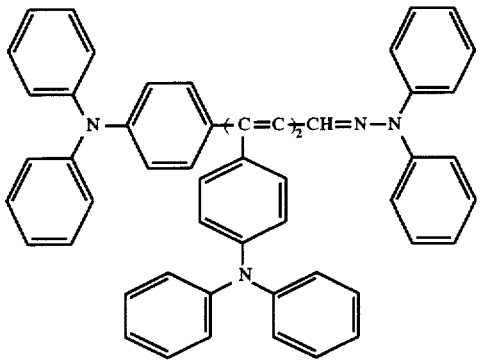
No. 35
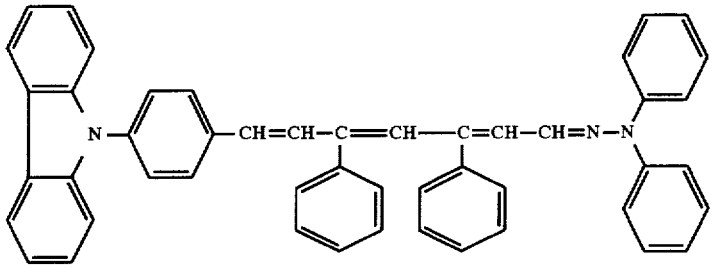
No. 36
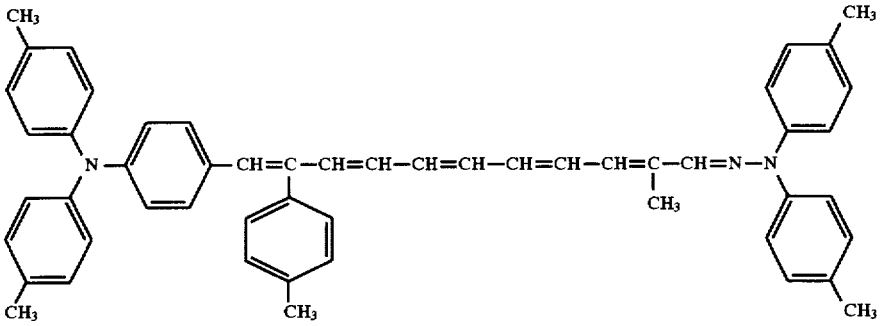
No. 37
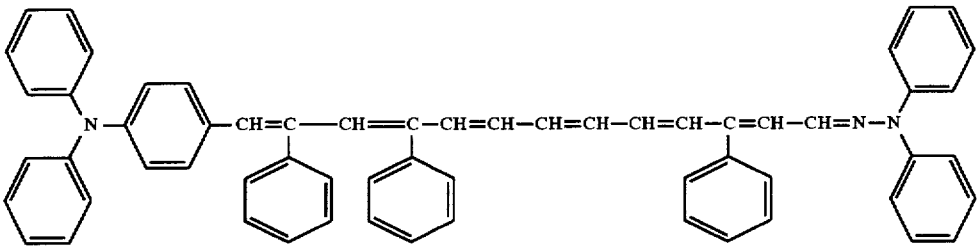
No. 38
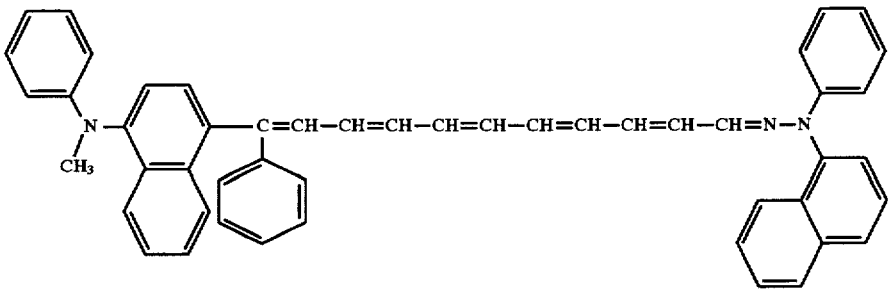

-continued
No. 39
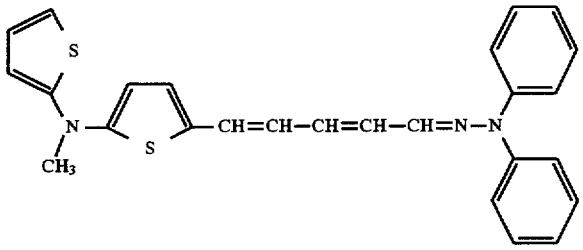
No. 40
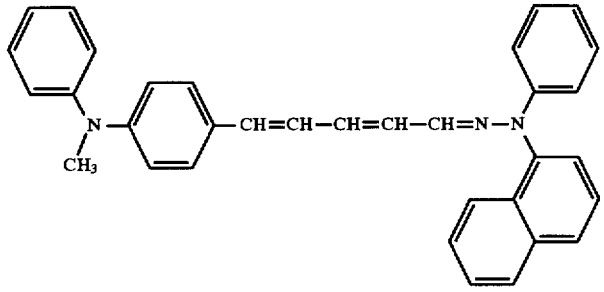
No. 41
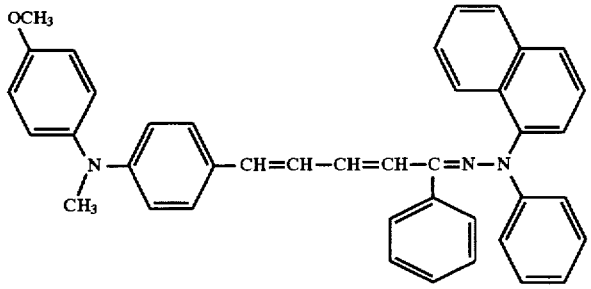
No. 42
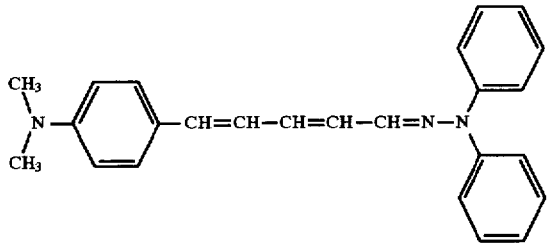
No. 43
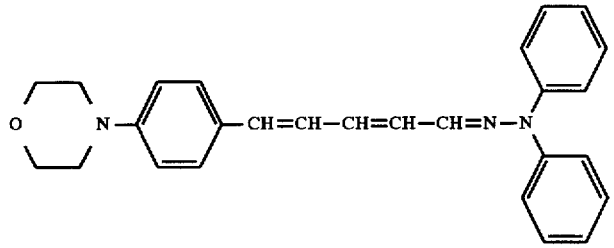
No. 44
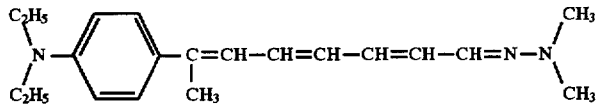

-continued

No. 45

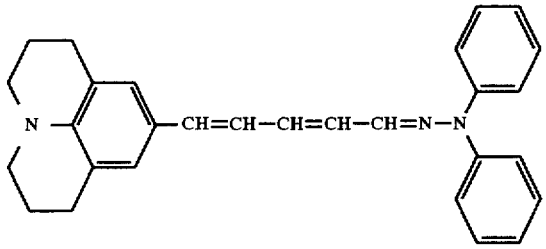

No. 46

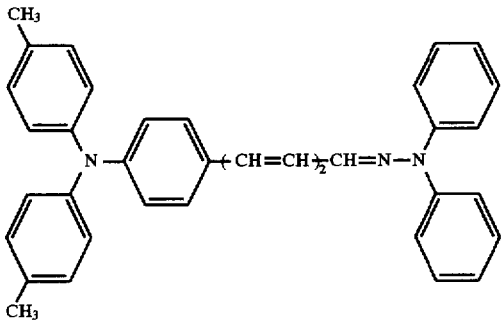

Of these compounds, Nos. 1, 2, 3, 7, 8, 9, 10, 15, 20, 28, 30 and 46 are preferred.

The arylamine hydrazone compounds represented by the formula [I] can be produced by the known methods. For instance, a method may be employed in which a known arylamine compound is subjected to a known carbonyl group-introducing reaction, followed by a preferred number of times of known Wittig-Horner-Emmons reaction and known carbonyl group-introducing reaction, and the resulting reaction product is further subjected to a dehydration with a pertinent hydrazine to produce the objective compound. This method is discussed more particularly below.

First, an arylamine compound is subjected to the following carbonyl group introducing reaction:

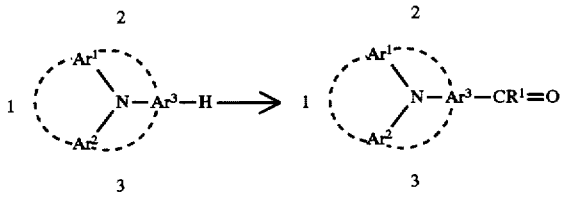

[XX] [XXI]

wherein $Ar^1$, $Ar^2$, $Ar^3$, dotted line 1, dotted line 2, dotted line 3 and $R^1$ represent the same as defined in the formula [1].

(i) When $R^1$=H:

An arylamine compound of the formula [XX] is reacted with a formylating agent such as N,N-dimethylformamide, N-methylformanilide or the like in the presence of phosphorus oxychloride to produce an aldehyde-form represented by the formula [XXI]. The formylating agent may be used concurrently as a reaction solvent by use of large excess. It is also possible to use a solvent inert to the above reaction such as o-dichlorobenzene, benzene or the like.

(ii) When $R^1 \neq H$:

An arylamine compound of the formula [XX] is reacted with an acid chloride represented by the formula $R^1$-COCl in a solvent such as nitrobenzene, dichloromethane, carbon tetrachloride or the like in the presence of a Lewis acid such as aluminum chloride, iron chloride, zinc chloride or the like to produce a ketone-form represented by the formula [XXI].

Then, the arylamine compound of the formula [XXI] is reacted with a phosphonium salt represented by the formula $[R^2—CH_2PPh_3]^+w^-$ (wherein w represents a halogen atom such as chlorine atom, bromine atom or iodine atom, and Ph represents phenyl group) or an alkylphosphorous diester represented by the formula $[R^2—CH_2P(O)(OR)_2]$ (wherein R represents $C_1$–$C_5$ alkyl group) in a solvent inert to the reaction, such as N,N-dimethylformamide, dioxane, toluene, benzene, tetrahydrofuran or the like, in the presence of a base such as potassium-tert-butoxide, lithium ethoxide, sodium methoxide, sodium hydride or the like, according to the following reaction scheme (Wittig-Horner-Emmons reaction) to produce an arylamine compound represented by the formula [XXII]:

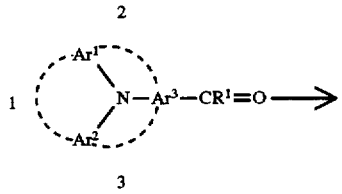

[XXI]

-continued

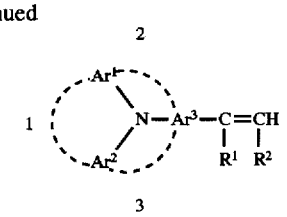

[XXII]

wherein $Ar^1$, $Ar^2$, $Ar^3$, dotted line 1, dotted line 2, dotted line 3, $R^1$ and $R^2$ represent the same as defined in the formula [I].

This arylamine compound of the formula [XXII] is then subjected to the said carbonyl group-introducing reaction to produce an arylamine compound represented by the formula [XXIII]:

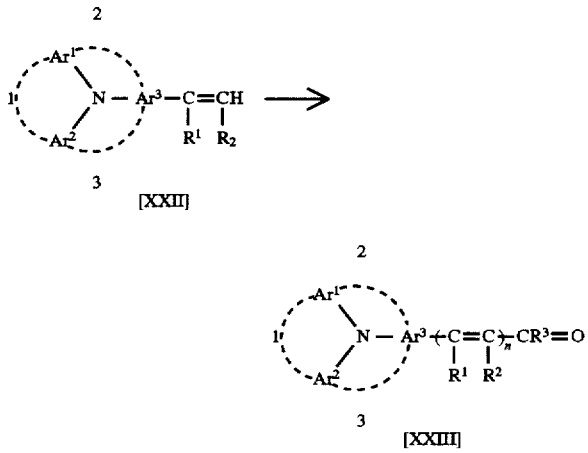

[XXIII]

wherein $Ar^1$, $Ar^2$, $Ar^3$, dotted line 1, dotted line 2, dotted line 3, $R^1$, $R^2$, $R^3$ and n represent the same as defined in the formula [I].

The arylamine compound of the formula [XXIII] is subjected to a necessary number of times of the said Wittig-Horner-Emmons reaction and carbonyl group-introducing reaction to produce an arylamine compound represented by the formula [XXIV]:

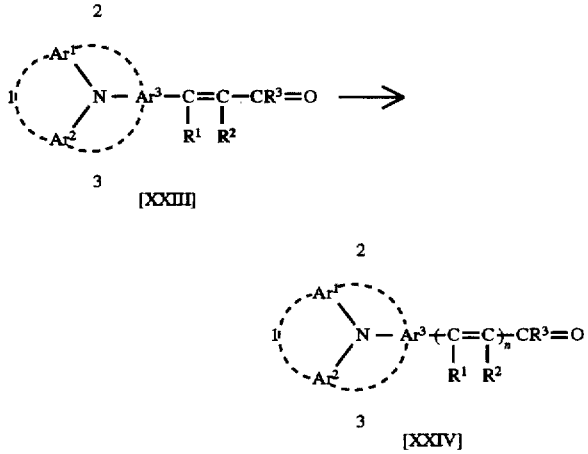

[XXIV]

wherein $Ar^1$, $Ar^2$, $Ar^3$, dotted line 1, dotted line 2, dotted line 3, $R^1$, $R^2$, $R^3$ and n represent the same as defined in the formula [I].

This arylamine compound of the formula [XXIV] is subjected to a dehydration/condensation reaction with a hydrazine represented by the formula $H_2N$-Q to obtain an arylamine hydrazone compound represented by the formula [I]:

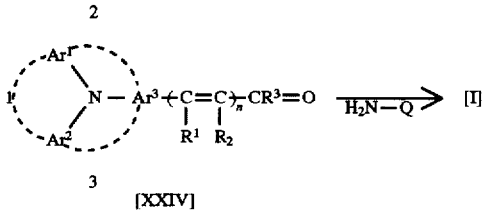

[XXIV]

The dehydration/condensation reaction (hydrazone-forming reaction) may, if necessary, be carried out under heating at 50°–150° C. in a solvent inert to the reaction such as methanol, ethanol, tetrahydrofuran, cellosolve, N,N-dimethylformamide, benzene, toluene or the like, and if desired, an adjuvant such as paratoluenesulfonic acid, hydrochloric acid, sodium acetate or the like as a reaction accelerator.

In these reactions, a known purification means such as recrystallization, sublimation, column chromatography, etc., may be carried out at the end of each step or at the end of the whole process to obtain a high-purity product.

The electrophotographic photoreceptor according to the present invention has a photosensitive layer containing at least one arylamine hydrazone compound represented by the formula [I].

The arylamine compounds represented by the formula [I] show very excellent performance as an organic photoconductor, and when they are used as a charge transport material, a photoreceptor with high sensitivity and excellent durability can be obtained.

There are known various types of photosensitive layer of electrophotographic photoreceptors, and the compounds of the present invention can be applied to any type of photosensitive layer. Among the known types of photosensitive layer are the one formed by adding an arylamine hydrazone compound and, if necessary, a pigment or an electron attractive compound serving as a sensitizer in a binder; the one comprising the photoconductive particles which generate a charge carrier at very high efficiency on absorbing light, an arylamine hydrazone compound and a binder; and the one comprising a laminate of a charge transport layer containing an arylamine hydrazone compound and a binder, and a charge generation layer composed of the photoconductive particles which generate a charge carrier at very high efficiency on absorbing light or composed of the said particles and a binder.

These photosensitive layers may contain, in addition to an arylamine hydrazone compound of the formula [I], other known arylamine compounds, hydrazone compounds, stilbene compounds, etc., having excellent performance as an organic photoconductor.

According to the present invention, by incorporating an arylamine hydrazone compound of the formula [I] in the charge transport layer of the dual photosensitive layer comprising of a charge generation layer and a charge transport layer, there can be obtained a high-durability photoreceptor which is high in sensitivity, small in residual potential, and minimized in variation of surface potential and drop of sensitivity when the photoreceptor is used repeatedly or exposed to strong light, and also small in accumulation of residual potential.

The electrophotographic photoreceptor of the present invention can be produced by forming on a substrate a photosensitive layer according to a conventional process comprising the steps of preparing a coating solution by dissolving an arylamine hydrazone compound represented by the formula [I] and a binder in an appropriate solvent; if necessary, adding to the solution the photoconductive particles which generate a charge carrier at very high efficiency on absorbing light, a sensitizing dye, an electron attractive compounds and other additives such as plasticizer, pigment, etc.; applying this coating solution on a conductive substrate; and drying the coating to form a photosensitive layer with a thickness of usually several to several ten μm, preferably 10 to 40 μm. When the photosensitive layer comprises a double-layer structure of a charge generation layer and a charge transport layer, the said coating solution is applied on the charge generation layer, or the charge generation layer is formed on the charge transport layer obtained by applying the said coating solution.

The solvents usable for preparing the coating solution include ethers such as tetrahydrofuran and 1,4-dioxane; ketones such as methyl ethyl ketone and cyclohexanone; aromatic hydrocarbons such as toluene and xylene; aprotic polar solvents such as N,N-dimethylformamide, acetonitrile, N-methylpyrrolidone and dimethylsulfoxide; esters such as ethyl acetate, methyl formate and methylcellosolve acetate; chlorinated hydrocarbons such as dichloroethane and chloroform, and other solvents capable of dissolving the arylamine hydrazone compounds. Of course the solvent used here needs to be capable of dissolving the binder used. Examples of the binders usable for the said purpose include polymers and copolymers of vinyl compounds such as styrene, vinyl acetate, vinyl chloride, acrylic acid esters, methacrylic acid esters and butadiene, and various kinds of polymers compatible with the arylamine hydrazone compounds, such as polyvinyl acetals, polycarbonates, polyesters, polysulfones, polyphenylene oxide, polyurethanes, cellulose esters, cellulose ethers, phenoxy resins, silicon resins and epoxy resins. The binder is usually used in an amount of 0.5–30 times, preferably 0.7–10 times by weight to the arylamine hydrazone compound.

The particles, dye pigment and electron attractive compound as the charge generation material which is added to the said photosensitive layer may be of the known types. As the particles of charge generation material which generates a charge carrier at very high efficiency on absorbing light, there can be used the inorganic photoconductive particles such as the particles of selenium, selenium-tellurium alloy, selenium-arsenic alloy, cadmium sulfide, amorphous silicon, etc., and organic photoconductive particles such as the particles of metal-containing phthalocyanines, perynone pigments, thioindigo, quinacridone, perylene pigments, anthraquinone pigments, azo pigments, bisazo pigments, triazo pigments, tetrakis azo pigments, cyanine pigments, etc. Especially, a photoreceptor which is improved for the sensitivity to laser light and is small in residual potential, can be obtained by using a metal-containing phthalocyanine with the arylamine hydrazone compound. Further, azo pigments, especially those having a coupler of the following structural formula [IX], are also preferred:

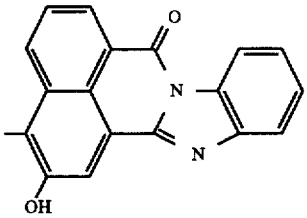

[IX]

The dyes usable as an additive in the photoreceptor of the present invention include triphenylmethane dyes such as methyl violet, brilliant green and crystal violet; thiazine dyes such as methylene blue; quinone dyes such as quinizarin; cyanine dyes; pyrylium salts, thiapyrylium salts, benzopyrylium salts, etc. As the electron attractive compound which forms a charge transport material with the arylamine hydrazone compound, there can be used, for instance, quinones such as chloranil, 2,3-dichloro-1,4-naphthoquinone, 1-nitroanthraquinone, 1-chloro-5-nitroanthraquinone, 2-chloroanthraquinone and phenanthrenequinone; aldehydes such as 4-nitrobenzaldehyde; ketones such as 9-benzoylanthracene, indandion, 3,5-dinitrobenzophenone, 2,4,7-trinitrofluorenone, 2,4,5,7-tetranitrofluorenone, and 3,3',5,5'-tetranitrobenzophenone; acid anhydrides such as phthalic anhydride and 4-chloronaphthalic anhydride; cyano compounds such as tetracyanoethylene, tetraphthalylmalononitrile, 9-anthrylmethylidenemalononitrile, 4-nitrobenzalmalononitrile and 4-(p-nitrobenzoyloxy) benzalmalononitrile; and phthalides such as 3-benzalphthalide, 3-(α-cyano-p-nitrobenzal)phthalide and 3-(α-cyano-p-nitrobenzal)-4,5,6,7-tetrachlorophthalide.

The photosensitive layer of the electrophotographic photoreceptor according to the present invention may further contain a known plasticizer for improving the film-forming properties, flexibility and mechanical strength. The plasticizers that can be added in the said coating solution for the said purpose include aromatic compounds such as phthalic esters and methylnaphthalene, phosphoric esters, epoxy compounds, chlorinated paraffin, chlorinated and fatty acid esters. When an arylamine hydrazone compound is used as a charge transport material in the charge transport layer, the coating solution may be of the said composition or the photoconductive particles, dye/pigment and electron attractive compound are excluded from the composition or added only in small quantities. In this case, the charge generation layer may be formed, for instance, by dissolving or dispersing the said photoconductive particles and, if necessary, a binder polymer, organic photoconductive material, dye/pigment, electron attractive compound and/or the like in a solvent to prepare a coating solution, and applying this coating solution and drying the coat to form a thin layer, or by depositing the said photoconductive particles by vacuum deposition.

The photosensitive layer of the electrophotographic photoreceptor of the present invention may also contain known additives for improving electrical properties and/or durability to repeated use. The agents that may be added in the coating solution for the said purpose include phenol compounds, organic phosphorus compounds and organic sulfur compounds.

The photoreceptor of the present invention may also have as desired an adhesive layer, an intermediate layer, a transparent insulating layer, etc.

As the conductive substrate on which the photosensitive layer is formed, there can be used those employed in the conventional electrophotographic photoreceptors. For example, drums and sheets of metals such as aluminum, stainless steel, copper, etc., laminates of their metal foils, deposits of these metals; plastic films, plastic drums, paper and paper tube which have been made conductive by applying a conductive material such as metal powder, carbon black, copper iodide, polymeric electrolyte or the like with a binder; and plastic sheets and drums which have been made conductive by incorporating a conductive material such as metal powder, carbon black, carbon fiber, etc., can be used.

As described above, the electrophotographic photoreceptor according to the present invention has remarkably high sensitivity, low residual potential causative of fogging, and most notably, small optical fatigue, resulting in reduced accumulation of residual potential due to repeated use or exposure to strong light, reduced variation of surface potential and sensitivity, and improved durability. Also, since a carrier transport material with high hole drift mobility is used in the electrophotographic photoreceptor of the present invention, the electrophotographic process using this photoreceptor is raised in speed, allowing high-speed copying. Therefore, when the photoreceptor is a drum, a reduction of diameter can be realized. Further, because of high drift mobility, the charging performance of the photoreceptor won't be reduced excessively even at low temperatures such as around 5° C., so that a normal image can be obtained even under such low-temperature conditions.

EXAMPLES

The present invention is explained in more detail in the following examples; however, it should be recognized that the following examples are presented for illustrative purposes only and should not be construed as limiting the scope of the invention. In the following descriptions of the examples, all "parts" are by weight unless otherwise noted.

(1) Half-decay exposure intensity

The half-decay exposure intensity was determined in the following way. The photoreceptor was negatively charged by applying a corona current of 50 μA and then exposed to light with a wavelength of 780 nm (exposure energy: 10 $\mu W/cm^2$) obtained by passing white light of 20 luxes through an interference filter, and the exposure intensity required for attenuating the surface potential from −450 V to −225 V was measured. The sensitivity determined in this way is referred to as sensitivity 1. In the present invention, sensitivity 1 is preferably not larger than 0.7 $\mu J/cm^2$, more preferably not larger than 0.60 $\mu J/cm^2$.

In certain cases, the photoreceptor was exposed directly to the said white light (without passing it through an interference filter) and the sensitivity was determined in the same way as described above. The thus determined sensitivity is referred to as sensitivity 2. In the present invention, sensitivity 2 is preferably be not larger than 1.50 lux.sec, more preferably not larger than 1.20 lux.sec.

(2) Residual potential

The surface potential observed when the exposure time was set at 9.9 seconds in determination of the half-decay exposure intensity described in (1) above was expressed as residual potential. In the present invention, absolute value of residual potential after exposure by the light with a wavelength of 780 nm is preferably not larger than 25 V, more preferably not larger than 20 V. The absolute value of residual potential after exposure by white light is preferably not larger than 30 V, more preferably not lager than 25 V.

Production Example 1

To a solution of 59.7 g of triphenylphosphine in 340 ml of toluene, 25 g of allyl bromide was added dropwise over a period of 20 minutes and the resulting solution was heated under reflux for 3 hours.

After cooled, the reaction solution was filtered and washed sprinkling with 600 ml of toluene to give 71.2 g of a Wittig reagent represented by the following structural formula (wherein Ph represents phenyl group):

$$CH_2{=}CH{-}CH_2{-}PPh_3Br^-$$

The 18.2 g of obtained Wittig reagent and 10.0 g of triphenylaminecarboxaldehyde were suspended in 100 ml of N,N-dimethylformamide. After replacing the system atmosphere with nitrogen, 10.6 g of a 28% methanol solution of sodium methoxide was added dropwise to the suspension and reacted at room temperature for 3 hours. The reaction solution was discharged into 200 ml of desalted water and extracted, concentrated and purified by the conventional methods to obtain 7.7 g of an arylamine compound represented by the following structural formula:

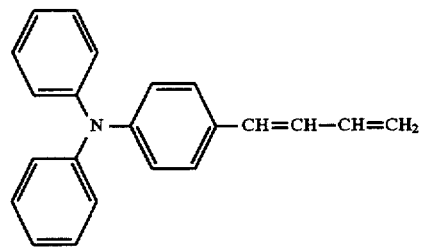

The 5.5 g of obtained arylamine compound was dissolved in 50 g of N,N-dimethylformamide, and 3.4 g of phosphorus oxychloride was added dropwise to this solution under ice cooling. After reacting the mixture at room temperature for one hour, the reaction solution was heated to 60° C. over a period of 45 minutes and then further reacted at 60° C. for 3 hours.

After the reaction solution was cooled, it was discharged into 40 ml of ice-cold water and 7.1 g of a 50% sodium hydroxide solution was added dropwise thereto. The resulting solution was stirred for one hour and then extracted, concentrated and purified by the conventional method to give 5.4 g of an arylamine compound represented by the following structural formula:

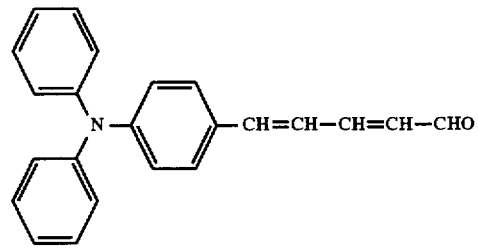

The 5.4 g of obtained arylamine compound was dissolved in a mixed solvent of 8 ml of toluene and 16 ml of THF, and after replacing the system atmosphere with nitrogen, 40 ml of an acetic acid/methanol solution of 4.6 g of 1,1-diphenylhydrazine was added dropwise to the solution over a period of 5 minutes. After reacting the mixture at 50°–60° C. for one hour, 70 ml of methanol was added dropwise to the reaction solution over a period of 5 minutes. Thereafter, the solution was reacted for one hour and then, after the reaction solution was cooled to room temperature, further reacted for 2 hours. The reaction solution was filtered and then purified in the conventional way to obtain 2.2 g of an orange-colored solid matter.

This compound was identified as an arylamine hydrazone compound represented by the structural formula of the exemplary compound No. 1 from the results of elemental analysis shown in Table 1 and the IR absorption spectrum shown in FIG. 1.

TABLE 1

Anal. Calcd. for $C_{35}H_{29}N_3$ by elemental analysis:

| | C % | H % | N % |
|---|---|---|---|
| Calcd.: | 85.51 | 5.95 | 8.55 |
| Found: | 85.42 | 6.02 | 8.56 |

Mass spectrometric analysis, calcd. for $C_{35}H_{29}H_3$:
Mw=492
M+=492

Example 1

To 14 parts of dimethoxyethane, 1.0 part of a titanium oxyphthalocyanine pigment which shows strong diffraction peaks at Bragg's angles (2θ±0.2°) of 9.3°, 10.6°, 13.2°, 15.1°, 15.7°, 16.1°, 20.8°, 23.3° and 27.1° on the X-ray diffraction spectrum was added and dispersed by a sand grinder. Then the solution was diluted by adding 14 parts of dimethoxyethane and 14 parts of 4-methoxy-4-methyl-2-pentanone. To this dilute solution, a solution prepared by dissolving 0.5 part of polyvinyl butyral (Denka Butyral #6000-C, trade name, available from Denki Kagaku Kogyo KK) and 0.5 part of a phenoxy resin (UCAR (registered trade mark) PKHH, available from Union Carbide Inc.) in a mixed solvent of 6 parts of methoxyethane and 6 parts of 4-methoxy-4-methyl-2-pentanone, was mixed to obtain a dispersion. This dispersion was wire bar coated on an aluminum deposit provided on a 75 μm thick polyester film so that the dry coating weight would become 0.4 g/m$^2$, and then dried to form a charge generation layer.

On this charge generation layer, a coating solution prepared by dissolving 70 parts of the arylamine hydrazone compound produced in Production Example 1 and 100 parts of a polycarbonate resin having the following structure:

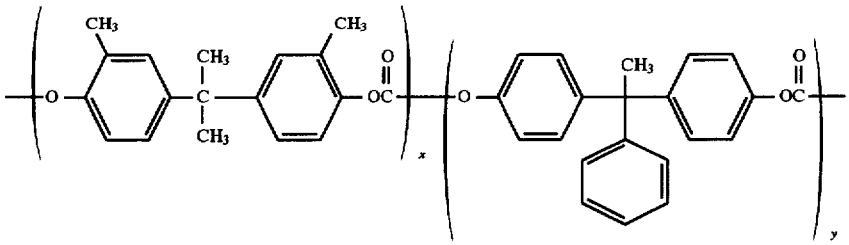

x:y = 1:1 in a mixed solvent of 585 parts of tetrahydrofuran and 315 parts of dioxane, was applied and dried to form a 17 μm thick charge transport layer.

The half-decay exposure intensity (sensitivity 1) measured of an electrophotographic photoreceptor having a photosensitive layer consisting of the said charge generation layer and charge transport layer was 0.46 μJ/cm$^2$. The residual potential of this electrophotographic photoreceptor was −6 V. Measurement of residual potential was repeated 2,000 times, but no rise of residual potential was recognized.

Example 2

An electrophotographic photoreceptor was made by following the same procedure as Example 1 except that a titanium oxyphthalocyanine pigment showing strong diffraction peaks at Bragg's angles (2θ±0.2°) of 9.5°, 27.1° and 27.3° on the X-ray diffraction spectrum was used in place of the titanium oxyphthalocyanine pigment used in Example 1. This photoreceptor was exposed to light with a wavelength of 780 nm and its half-decay exposure intensity (sensitivity 1) measured was 0.12 μJ/cm$^2$. The residual potential of it was −16 V.

Example 3

An electrophotographic photoreceptor was made according to the procedure of Example 1 except that a naphthalic bisazo pigment represented by the following structural formula was used in place of the phthalocyanine pigment. The half-decay exposure intensity (sensitivity 2) of this photoreceptor as measured by exposing it to white light was 0.83 lux.sec. The residual potential of it was −10 V.

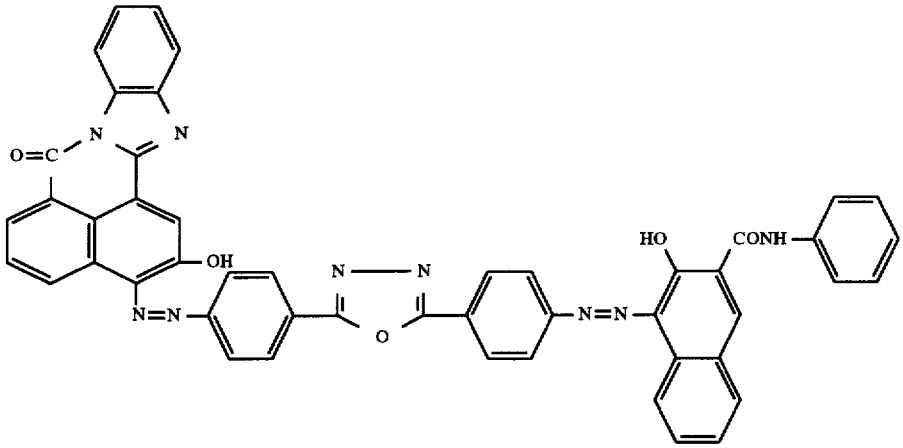

Example 4

An electrophotographic photoreceptor was made according to the procedure of Example 1 except that a naphthalic bisazo pigment represented by the following structural formula was used in place of the phthalocyanine pigment. The half-decay exposure intensity (sensitivity 2) of this photoreceptor measured by exposing it to white light was 1.05 lux.sec. The residual potential of it was −12 V.

TABLE 2-continued

| | Exemplary compound No. | Sensitivity 1 (μJ/cm²) | Residual potential (V) |
|---|---|---|---|
| Example 10 | 28 | 0.49 | −7 |
| Example 11 | 30 | 0.47 | −5 |

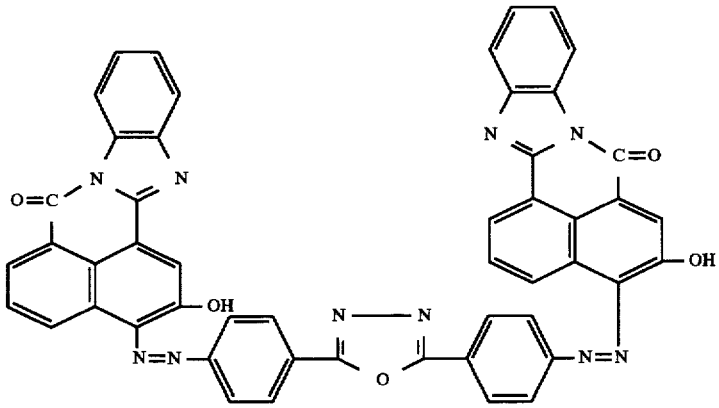

Examples 5–11

Electrophotographic photoreceptors were made according to the procedure of Example 1 except the arylamine hydrazone compounds shown in Table 2, synthesized in the same way as Production Example 1, were used in place of the arylamine hydrazone compound used in Example 1. the sensitivity and residual potential of these photoreceptors are shown in Table 2.

TABLE 2

| | Exemplary compound No. | Sensitivity 1 (μJ/cm²) | Residual potential (V) |
|---|---|---|---|
| Example 5 | 2 | 0.58 | −16 |
| Example 6 | 8 | 0.58 | −15 |
| Example 7 | 11 | 0.49 | −5 |
| Example 8 | 15 | 0.48 | −7 |
| Example 9 | 20 | 0.70 | −8 |

Examples 12–18

Electrophotographic photoreceptors were made according to the procedure of Example 3 except that the arylamine hydrazone compounds shown in Table 3, synthesized in the same way as Production Example 1, were used in place of the arylamine hydrazone compound used in Example 1. The sensitivity and residual potential of these photoreceptors are shown in Table 3.

TABLE 3

| | Exemplary compound No. | Sensitivity 2 (lux · sec) | Residual potential (V) |
|---|---|---|---|
| Example 12 | 2 | 0.93 | −15 |
| Example 13 | 8 | 0.92 | −17 |
| Example 14 | 11 | 0.83 | −8 |
| Example 15 | 15 | 0.84 | −9 |
| Example 16 | 20 | 1.10 | −11 |

TABLE 3-continued

| | Exemplary compound No. | Sensitivity 2 (lux · sec) | Residual potential (V) |
|---|---|---|---|
| Example 17 | 28 | 0.85 | −11 |
| Example 18 | 30 | 0.83 | −9 |

Examples 19–22

Electrophotographic photoreceptors were made according to the procedure of Example 4 except that the arylamine hydrazone compounds shown in Table 4, synthesized in the same way as Production Example 1, were used in place of the arylamine hydrazone compound used in Example 4. The sensitivity and residual potential of these photoreceptors are shown in Table 4.

TABLE 4

| | Exemplary compound No. | Sensitivity 2 (lux · sec) | Residual potential (V) |
|---|---|---|---|
| Example 19 | 3 | 1.21 | −21 |
| Example 20 | 7 | 1.32 | −20 |
| Example 21 | 9 | 1.09 | −14 |
| Example 22 | 46 | 0.93 | −10 |

Comparative Example 1

An electctrophotographic photoreceptor was made according to the procedure of Example 1 except that a comparative compound 1 having the following structural formula was used in place of the arylamine hydrazone compound. The sensitivity and residual potential of this photoreceptor are shown in Table 5 along with the determination results of the photoreceptor of Example 1.

Comparative compound 1:

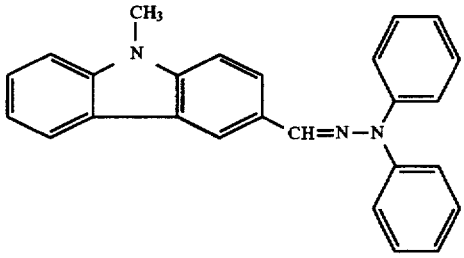

Comparative Example 2

An electrophotographic photoreceptor was made according to the same procedure as Comparative Example 1 except that a comparative compound 2 having the following structural formula was used in place of the comparative compound 1. The sensitivity and residual potential of this photoreceptor are shown in Table 5.

Comparative compound 2:

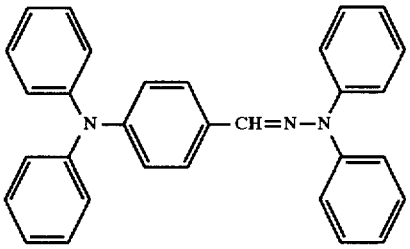

Comparative Example 3

An electrophotographic photoreceptor was made according to the same procedure as Comparative Example 1 except that a comparative compound 3 having the following structural formula was used in place of the comparative compound 1. The sensitivity and residual potential of this photoreceptor are shown in Table 4.

Comparative compound 3:

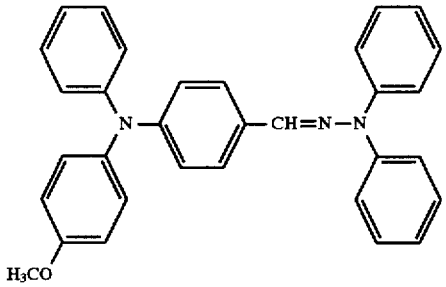

TABLE 5

| | Sensitivity 1 (μJ/cm²) | Residual potential (V) |
|---|---|---|
| Comparative Example 1 | 0.60 | −27 |
| Comparative Example 2 | 0.59 | −12 |
| Comparative Example 3 | 0.59 | −11 |
| Example 1 | 0.46 | −6 |

As is seen from Table 5, the compound of Example 1 shows good numerical values in both sensitivity and residual potential as compared with the compounds of Comparative Examples 1, 2 and 3.

Comparative Examples 4–6

Electrophotographic photoreceptors were made according to the same procedure as Example 4 except that the comparative compounds 4, 5 and 6 shown below were used in place of the arylamine hydrazone compound. The sensitivities of these photoreceptors are shown in Table 6. Those of Examples 4, 21 and 22 are also shown therewith for reference.

Comparative compound 4:

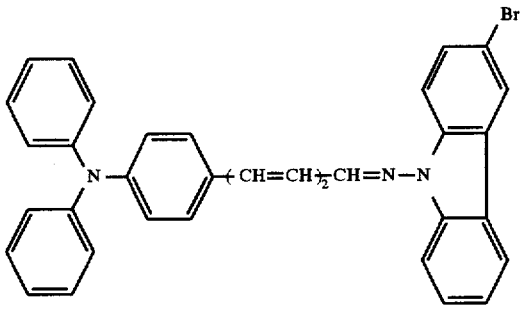

Comparative compound 5:

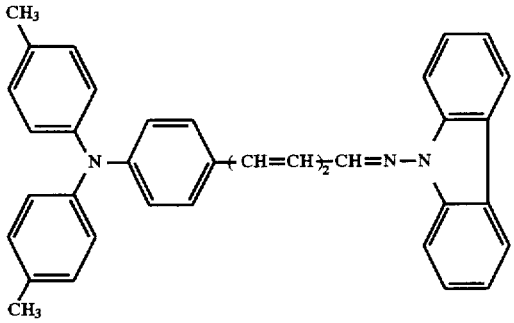

Compound compound 6:

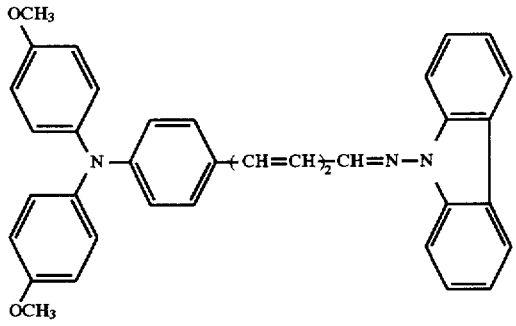

TABLE 6

| | Sensitivity 2 (lux · sec) | Hydrazone compound |
|---|---|---|
| Comparative Example 4 | 2.10 | Comparative compound 4 |
| Comparative Example 5 | 1.72 | Comparative compound 5 |
| Comparative Example 6 | 1.45 | Comparative compound 6 |
| Example 4 | 1.05 | Exemplary compound No. 1 |
| Example 21 | 1.09 | Exemplary compound No. 9 |
| Example 22 | 0.93 | Exemplary compound No. 46 |

It is seen from Table 6 that the compounds of the formula [I] in which n=2 and Q is a group of a specific structure are inferior in sensitivity to the compounds [I] of other structures.

Example 23

A half-transparent Al electrode was deposited to a thickness of 0.4 μm as an opposing electrode on an electrophotographic photoreceptor having a dual photosensitive layer obtained by the same operations as in Example 1.

The photoreceptor was exposed via the half-transparent Al electrode to the light obtained by passing white light from a xenon flash lamp through a red filter (trade name: R-60, mfd. by Toshiba Glass Co., Ltd.) and an interference filter to determine the transit photocurrent. The hole drift mobility was also measured according to the time-of-flight (TOF) method. In the present invention, it is preferable that the hole drift mobility is not less than 4.5 $cm^2/Vs$ when the electric field is $2\times10^5$ V/cm.

Figure 2:
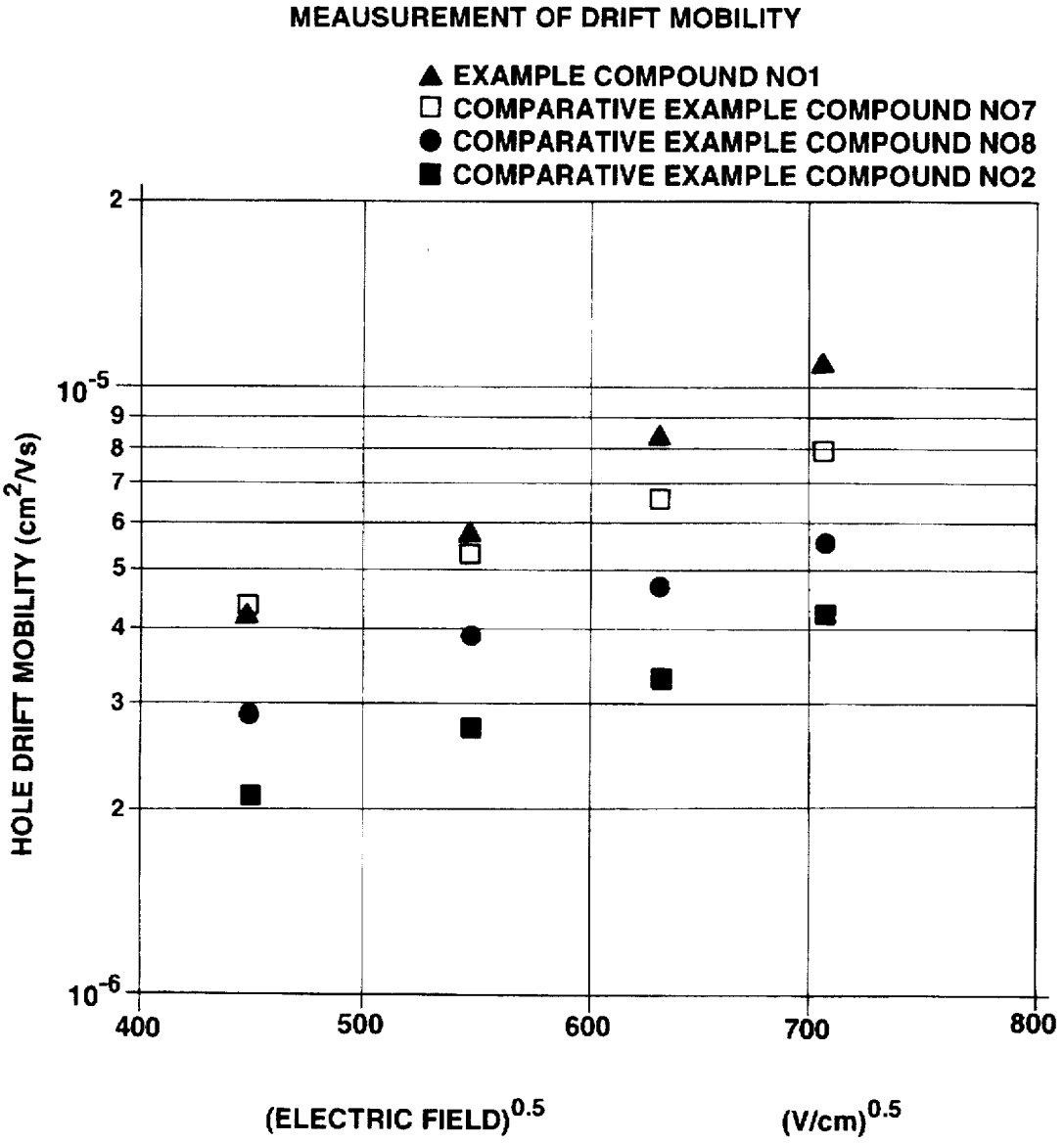
FIG. 2 shows the electric field and hole drift mobility of the electrophotographic photoreceptor measured in Example 23.

There were also made the samples of photoreceptor deposited with an opposing electrode in the same way as described above except that the comparative compounds 7 and 8 shown below and the comparative compound 2 mentioned above were used in place of the arylamine hydrazone compound (exemplary compound No. 1) produced in Production Example 1, and the hole drift mobility was measured in the same manner as described above. The results are shown in Table 7 and FIG. 2 as hole drift mobility per the electric field given to the photoreceptor.

Comparative compound 7:

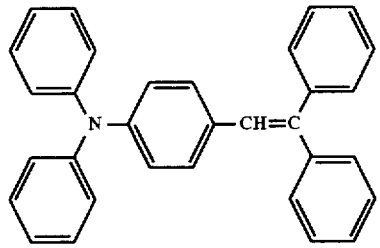

Comparative compound 8:

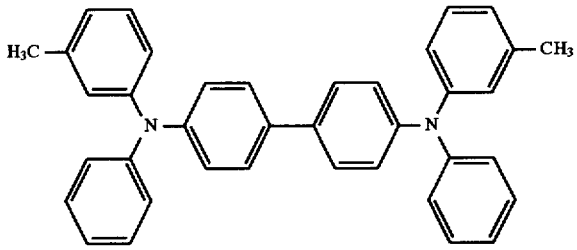

TABLE 7

| Electric field (V/cm) | Hole drift mobility × $10^6$ ($cm^2/Vs$) | | | |
|---|---|---|---|---|
| | Exemplary compound 1 | Comparative compound 7 | Comparative compound 8 | Comparative compound 2 |
| $2.00\times10^5$ | 4.50 | 4.35 | 2.87 | 2.09 |
| $3.00\times10^5$ | 5.99 | 5.31 | 3.89 | 2.72 |
| $4.00\times10^5$ | 7.82 | 6.56 | 4.72 | 3.29 |
| $5.00\times10^5$ | 10.0 | 7.94 | 5.58 | 4.24 |

It is seen from Table 7 that the exemplary compound No. 1 is notably high in hole drift mobility as compared with the comparative compounds.

Comparative Example 7

An electrophotographic photoreceptor was made according to the same procedure as Example 1 except that the comparative compound 7 was used in place of the exemplary compound used in Example 1. The sensitivity and residual potential of this photoreceptor were 0.53 μJ/cm$^2$ and −29 V, respectively.

What is claimed is:

1. An electrophotographic photoreceptor comprising a conductive substrate and a photosensitive layer formed thereon, the said photosensitive layer containing an arylamine hydrazone compound represented by the following formula [I]:

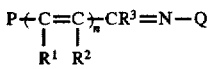

[I]

wherein n is an integer of 2 or more;

$R^1$, $R^2$ and $R^3$ represent independently a hydrogen atom, an alkyl group which may have one or more substituent groups, an aryl group which may have one or more substituent groups, or a heterocyclic group which may have one or more substituent groups, and $R^1$'s and $R^2$'s in each repeating unit may be different from each other;

P has formula [II]:

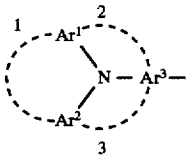

[II]

wherein $Ar^1$ and $Ar^2$ represent independently an alkyl group which may have one or more substituent groups, with the exclusion of benzyl or substituted benzyl an aryl group which may have one or more substituent groups, or a heterocyclic group which may have one ore more substituent groups, and $Ar^1$ and $Ar^2$ may be identical or different; $Ar^3$ represents an arylene group which may have one or more substituent groups or a heterocyclic group which may have one or more substituent groups; dotted line 1, dotted line 2 and dotted line 3 indicate that $Ar^1$ and $Ar^2$, $Ar^1$ and $Ar^3$, and $Ar^2$ and $Ar^3$ may be coupled directly or via a linking group, respectively;

Q has formula [III]:

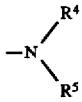

[III]

wherein $R^4$ and $R^5$ represent independently an aryl group which may have one or more substituent groups, a heterocyclic group which may have one or more substituent groups, an alkyl group which may have one or more substituent groups, or an aralkyl group which may have one or more substituent groups, provided that a compound where P in formula [I] having formula [IV] is excluded:

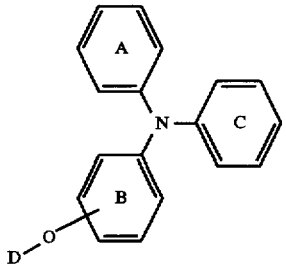

[IV]

wherein A, B and C benzene rings may independently have one or more substituent groups which may be identical or different; and D has one of formula [V], [VI] or [VII]:

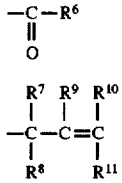

[V]

[VI]

[VII]

wherein, in the formula [V], Z represents an alkylene group which may have one or more substituent groups, and $Ar^4$ represents an aryl group which may have one or more substituent groups or a heterocyclic group which may have one or more substituent groups; in the formula [VI], $R^6$ represents an alkyl group which may have one or more substituent groups, an aryl group which may have one or more substituent groups, a heterocyclic group which may have one or more substituent groups or an aralkyl group which may have one or more substituent groups; and in the formula [VII], $R^7$, $R^8$, $R^9$, $R^{10}$ and $R^{11}$ represent independently a hydrogen atom, an alkyl group which may have one or more substituent groups, an aryl group which may have one or more substituent groups or a heterocyclic group which may have one or more substituent groups.

2. An electrophotographic photoreceptor according to claim 1, wherein P in the formula [I] is a group having formula [VIII]:

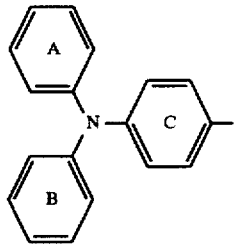

[VIII]

wherein A, B and C benzene rings may independently have one or more substituent groups which may be identical or different.

3. An electrophotographic photoreceptor according to claim 2, wherein A, B and C benzene rings in the formula [VIII] may independently be substituted by a methyl group or an ethyl group.

4. An electrophotographic photoreceptor according to claim 1, wherein $R^4$ and $R^5$ in the group represented by Q in the formula [I] are each an aryl group which may have one or more substituent groups.

5. An electrophotographic photoreceptor according to claim 1, wherein n in the formula [I] is an integer of 2 to 6.

6. An electrophotographic photoreceptor according to claim 1, wherein the photosensitive layer contains a carrier transport material and a carrier generation material, said carrier transport material being an arylamine hydrazone compound represented by the formula [I].

7. An electrophotographic photoreceptor according to claim 6, wherein the photosensitive layer comprises of a carrier generation layer containing a carrier generation material and a carrier transport layer containing a carrier transport material, said carrier transport material being an arylamine-hydrazone compound represented by the formula [I].

8. An electrophotographic photoreceptor according to claim 7, wherein the carrier transport layer contains a binder polymer.

9. An electrophotographic photoreceptor according to claim 6, wherein the carrier generation material is an azo pigment or a metal-containing phthalocyanine.

10. An electrophotographic photoreceptor according to claim 9, wherein the carrier generation material is an azo pigment having a coupler of the following structure [IX]:

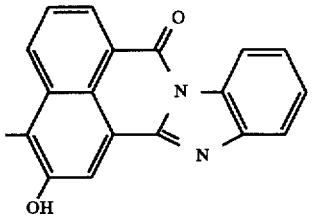

[IX]

* * * * *